US007630653B2

(12) United States Patent
Bonino

(10) Patent No.: US 7,630,653 B2
(45) Date of Patent: Dec. 8, 2009

(54) SYSTEM AND METHOD FOR IN-LINE SENSING AND MEASURING IMAGE ON PAPER REGISTRATION IN A PRINTING DEVICE

(75) Inventor: Paul Bonino, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 428 days.

(21) Appl. No.: 11/706,464

(22) Filed: Feb. 14, 2007

(65) Prior Publication Data

US 2008/0193148 A1 Aug. 14, 2008

(51) Int. Cl.
*G03G 15/00* (2006.01)
*G03G 15/01* (2006.01)

(52) U.S. Cl. ..... 399/15; 347/117; 399/301

(58) Field of Classification Search ..... 399/15, 399/301, 49, 72, 394, 395, 396, 405; 347/116
See application file for complete search history.

(56) References Cited

U.S. PATENT DOCUMENTS 5,260,725 A 11/1993 Hammond
5,374,993 A 12/1994 Diehl et al.
5,555,084 A 9/1996 Vetromile et al.
5,600,350 A 2/1997 Cobbs et al.
5,642,202 A 6/1997 Williams et al.
5,678,144 A * 10/1997 Osaki et al. ..... 399/167
6,452,147 B1 9/2002 Inada
6,467,867 B1 10/2002 Worthington et al.
6,763,199 B2 7/2004 Conrow et al.
6,895,210 B1 * 5/2005 Quesnel ..... 399/395
6,973,272 B2 * 12/2005 Yamamoto et al. ..... 399/15
7,133,056 B2 * 11/2006 Tanaka et al. ..... 347/116
7,420,719 B2 * 9/2008 Mongeon ..... 399/15 X
2004/0239746 A1 * 12/2004 Ozawa et al. ..... 347/116
2005/0207768 A1 * 9/2005 Suzuki ..... 399/49
2006/0153603 A1 * 7/2006 Nishikawa et al. ..... 399/301
2007/0172264 A1 * 7/2007 An ..... 399/301

* cited by examiner

*Primary Examiner*—Sophia S Chen
(74) *Attorney, Agent, or Firm*—Carter, DeLuca, Farrell & Schmidt, LLP

(57) ABSTRACT

A printing system and method is provided for adjusting image on paper (IOP) misregistration in a printing device. The method includes initiating marking of a substrate with a test pattern, the test pattern having at least one feature, and the marked substrate including at least two features including the at least one feature of the test pattern; sensing in a first sensing operation, as the substrate is transported in a process direction, a first feature of the marked substrate; sensing in a second sensing operation, as the substrate is transported in the process direction, a second feature of the marked substrate, wherein at least one of the first and second features is included in features of the test pattern; measuring a time differential between the sensing of the first and second features; and determining an IOP misregistration characteristic based on the measured time differential.

19 Claims, 7 Drawing Sheets

SYSTEM AND METHOD FOR IN-LINE SENSING AND MEASURING IMAGE ON PAPER REGISTRATION IN A PRINTING DEVICE

BACKGROUND

The present disclosure relates generally to a system and method for adjusting image on paper (IOP) registration in a printing device. In particular, the present disclosure relates to in-line sensing and measuring IOP registration in a printing device.

Printing devices, including electrophotographic printing devices, require a system and method for achieving proper IOP registration. In a xerographic printing device, IOP registration may be achieved by controlling registration of an imageable surface, such as a photoreceptor belt, an intermediate transfer belt if any, images to be transferred, and the substrate to which the image will be transferred.

First, IOP misregistration of an image transferred to a substrate is measured. Corrections are made, such as by adjusting parameters related to the transfer of the images to or from the image bearing surface in accordance with the determined misregistration. The adjusting may be performed, for example, by controlling parameters related to operation of a raster output scanner (ROS) imaging system or other latent or visible image forming system, operation of a paper registration system, and/or movement of the imageable surface.

IOP misregistration may be determined by measuring image offsets in the process and cross-process directions, image magnification in the process and cross-process directions, and image skew. The process direction is the direction in which the substrate onto which the image is transferred and developed moves through the image transfer and developing apparatus. The cross-process direction, along the same plane as the substrate, is substantially perpendicular to the process direction. Image skew is the angular deviation of the raster output scanner scan lines from the process direction of the substrate, or a line normal to the process direction of the marked substrate.

In prior art devices measurements such as those listed above may be made by printing a diagnostic image and taking measurements of the printed image. The printed image may be measured by hand using a magnifying eye loupe or may be scanned in and performed automatically. The results are then provided, typically manually, to a control system of the printing device. The control system uses the measurements to make adjustments for correcting any detected misregistration. The above process is performed offline (not inline), and requires human intervention, with the potential for human error.

There are prior art systems which perform IOP misregistration measurements in-line, e.g., as the substrate is moved through the printing device for marking of the substrate. A photo-detector array or CCD array is provided which acquires and records images of a substrate after a diagnostic image is transferred to the substrate. The images are processed, including taking measurements in the process and cross-process directions. The resultant measurements are provided to the control system of the printing device and used for making adjustments for improving IOP misregistration. The photo-detector arrays and CCD arrays add substantial cost to the printing device. Each image acquired includes an array of information which consumes substantial storage and processing resources.

To overcome the drawbacks in the prior art, it is an aspect of the present disclosure to provide a system and method for in-line measuring and correcting of IOP misregistration using simple inexpensive point sensors.

It is further an aspect of the present disclosure to provide a system and method in which the storing and processing of the sensor output consumes minimal resources.

SUMMARY

The present disclosure is directed to a method for adjusting image on paper (IOP) misregistration in a printing device, the method including receiving a marked substrate with a test pattern, the test pattern having at least one feature, and the marked substrate including at least two features including the at least one feature of the test pattern; sensing in a first sensing operation, as the substrate is transported in a process direction along a transport path, a first feature of the at least two features of the marked substrate; sensing in a second sensing operation, as the substrate is transported in the process direction along the transport path, a second feature of the at least two features of the marked substrate, wherein at least one of the first and second features is included in the at least one feature of the test pattern; measuring a time differential between the sensing of the first and second features; and determining an IOP misregistration characteristic based at least on the measured time differential.

The present disclosure is also directed to an electrophotographic printing system including a marking engine for transporting a substrate in a process direction and marking the substrate in accordance with an image of a test pattern, the test pattern having at least one feature, wherein the marked substrate includes at least two features including the at least one feature of the test pattern; an image on paper (IOP) registration station including at least one sensor for sensing the marked substrate as it is transported, including in a first sensing operation sensing a first feature of the at least two features of the marked substrate, and in a second sensing operation sensing a second feature of the at least two features of the marked substrate, wherein at least one of the first and second features is included in the at least one feature of the test pattern; a control unit including at least one processor; and an IOP registration module including a series of programmable instructions executable by the processor for measuring a time differential between the at sensing of the first and second features; and determining an IOP misregistration characteristic based at least on the measured time differential.

The present disclosure is also directed to a control unit of a printing system for correcting image on paper (IOP) misregistration, the control unit including a processor; and an IOP registration module including a series of programmable instructions executable by the processor for receiving a marked substrate with a test pattern having at least one feature, the marked substrate including at least two features including the at least one feature of the test pattern; processing signals associated with sensing a first feature of the at least two features of the marked substrate in a first sensing operation as the substrate is transported in a process direction along a transport path; processing signals associated with sensing a second feature of the at least two features of the marked substrate in a second sensing operation as the substrate is transported in the process direction along the transport path, wherein at least one of the first and second features is included in the at least one feature of the test pattern; measuring a time differential between the at sensing of the first and second features; and determining an IOP misregistration characteristic based at least on the measured time differential.

Other features of the presently disclosed printing system will become apparent from the following detailed description, taken in conjunction with the accompanying drawings, which illustrate, by way of example, the presently disclosed printing system.

BRIEF DESCRIPTION OF THE DRAWINGS

Various embodiments of the present disclosure will be described below with reference to the figures, wherein.

DETAILED DESCRIPTION

Figure 1:
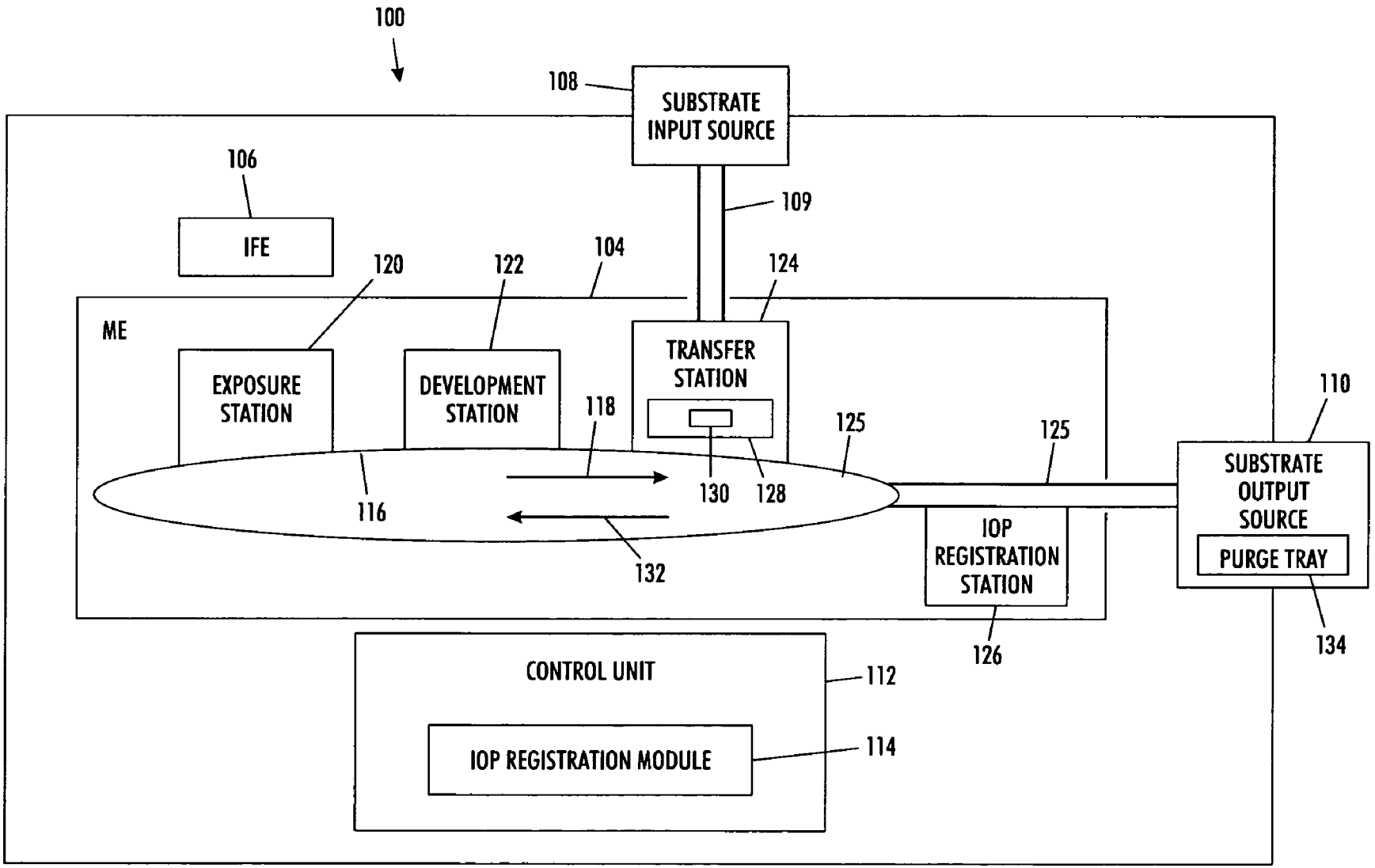
FIG. 1 is a block diagram of an exemplary printing system in accordance with the present disclosure.

Referring now to the drawing figures, in which like references numerals identify identical or corresponding elements, the image on paper (IOP) registration system and method in accordance with the present disclosure will now be described in detail. With initial reference to FIG. 1, an exemplary printing system in accordance with the present disclosure is illustrated and is designated generally as printing system 100. Printing system 100 includes a marking engine (ME) 104, an image forming engine (IFE) 106, at least one substrate input source 108, at least one substrate output source 110, and a control unit 112. The marking engine 104 includes a series of stations, including at least an exposure station 120, a development station 122, a transfer station 124 and an IOP registration station 126. The control unit 112 includes a processor an IOP registration control module 114 including a series of programmable instructions executable by the processor.

IOP registration station 126 includes at least one sensor for sensing features of a test diagnostic page formed by marking an image having a test pattern on a substrate. Timing of signals generated by the sensor responsive to the sensing of the features is used to determine misregistration values corresponding to detected misregistration of the marked image and correction control signals are generated which correspond to the misregistration values. The correction control signals are used by the IFE 106, or ME 104 for correcting the detected misregistration. The marking, sensing, determining misregistration values, and generation of correction control signals is performed in-line.

Some exemplary adjustments are now described. The image skew may be modified by adjusting the raster output scanner angular position of the raster output scanner relative to the photoreceptor belt. The process magnification may be adjusted by varying the speed of the photoreceptor belt. The process magnification and cross-process magnification may be adjusted by modifying the pixel clock frequency. The process offset (image to paper position in the process direction) may be modified by adjusting the time at which a sheet arrives at the transfer station. The cross-process offset (image to paper position in the cross-process direction) may be changed by adjusting the image using the first pixel delay after the start of scan signal of the raster output scanner unit. Additionally, the paper registration parameters or targets in the ME 104 may be adjusted to correct for process, cross-process, and skew misregistration.

Reference is made in this regard to U.S. Pat. Nos. 4,248,528; 4,627,721; 4,831,420; 5,153,577; 5,260,725; 5,555,084; 5,642,202; 5,697,608; 5,697,609; 5,760,914; 5,794,176; 5,821,971; 5,889,545; 5,892,854; 6,137,517; 6,141,464; 6,178,031; 6,201,937 and 6,275,244, each incorporated herein by reference in its entirety, which illustrate various methods and systems for adjusting image on paper registration parameters to achieve image skew, cross-process magnification, process magnification, cross-process direction image to paper position and process direction image to paper position.

The term "printing system" as used herein encompasses any apparatus or system, such as a digital copier, an electrophotographic printing system, ink jet printing system, solid ink printing system, offset printing system, lithographic printing system, reprographic printing system, bookmaking machine, facsimile machine, multifunction machine, textile marking machine, etc., which performs a marking output function for any purpose. The modality for marking may include, for example, applying toner, ink, dye, etc., to the substrate. The substrate may be a material such as paper, cardboard, a transparency, a paper derivative, metal, plastic, glass, wood, cloth, etc. In the example below, the printing system 100 is shown to be an electrophotographic, monocolor printing system marking a paper substrate with toner.

The printing system 100 is not limited to one marking engine 104, and may include multiple marking engines 104, where the IOP registration control module 114 controls registration of an image marked on a substrate by a first marking engine relative to an image marked on the substrate using a second marking engine of the multiple marking engine system. The marking engine 104 marks a substrate with an image generated by the image forming engine 106. In the present example, the marking engine 104 includes a photoreceptor belt 116 that is driven to move in a process direction, shown by arrow 118, to pass through the series of stations.

Charging station (not shown) applies a background charge on the photoreceptor belt 116. At the exposure station 120 the charged portion of the photoreceptor belt 116 is exposed to light generated by the image forming engine 106, where the exposure forms a latent image on the photoreceptor belt 116 where the photoreceptor belt is discharged. The exposed portion of the photoreceptor belt 116 then passes through a development station 122 in which toner particles are attracted to the latent image on the photoreceptor belt surface. Next, at transfer station 124, the toner is transferred from the photoreceptor belt surface to a paper substrate.

Transfer station 124 may include a paper registration system 128 that receives a paper substrate from the paper input source 108 via transport path 109, and registers the paper substrate so that it is properly aligned, without unwanted offsets in the process or cross-process directions (where the cross-process direction is substantially normal to the process direction), and without unwanted skew, before the toner is transferred to the paper substrate. The paper registration system 128 may include sensors 130 which provide signals indicative of the paper misregistration, e.g., including lateral or cross-lateral offset or skew of the substrate.

The photoreceptor belt and/or the paper substrate 116 may pass through additional stations, which are not shown, for treating the marked substrate and/or the photoreceptor belt 116 (such as for fusing, discharging, etc.), and may travel in a return direction, shown by arrow 132. Once marking and treating of the substrate is completed, the marked substrate is output, e.g., via transport path 125, to the substrate output source 110. Path 125 may coincide partially or completely with the photoreceptor belt 116.

Figure 2:
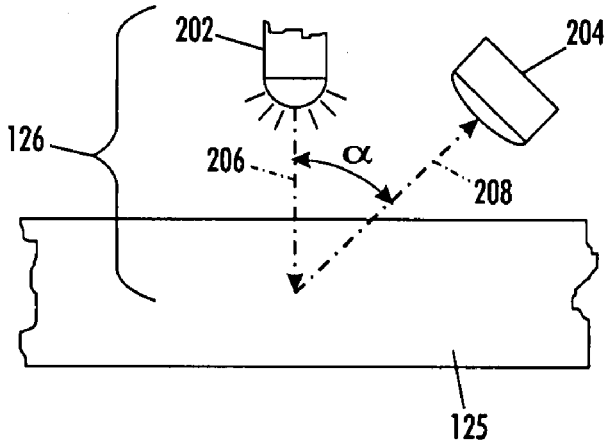
FIG. 2 is a schematic diagram of a first exemplary configuration of an image on paper (IOP) registration station of the printing system shown in FIG. 1.
Figure 3:
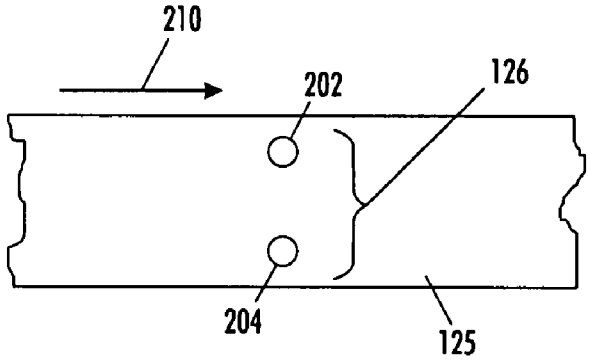
FIG. 3 is a bottom view schematic diagram of the first exemplary configuration of the IOP registration station of the printing system shown in FIG. 1.
Figure 4:
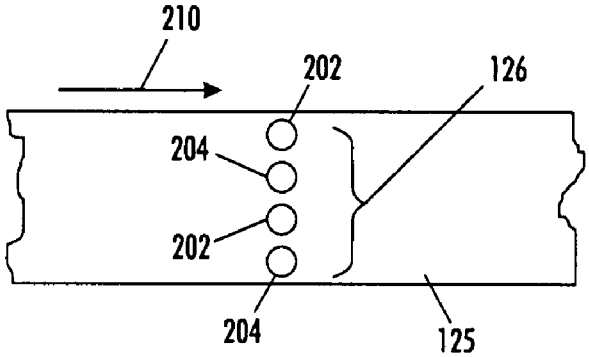
FIG. 4 is a bottom view schematic diagram of a second exemplary configuration of the IOP registration station of the printing system shown in FIG. 1.

The IOP registration station 126 is shown in greater detail in FIGS. 2-4. The IOP registration station 126 includes at least one light source 202 for generating light, and a sensor including at least one photodetector 204 for sensing light generated by the light source 202 that is reflected from the marked substrate. In the example provided, each photodetector 204 is a single point light detection device, such as a photodiode or a phototransistor, which generates a binary output. Each photodetector 204 may include a single component that generates a single binary signal which may be associated with one pixel of data. Furthermore, in the current example, the point sensors each collect one pixel of data. It is envisioned that the photodetectors of sensor 204 may be array sensors, e.g., CCD sensors, however the point sensors are significantly less expensive and the computation load is significantly lighter when using point sensors instead of CCD sensors.

The respective photodetectors are strategically positioned so that the light generated will be directed at the marked substrate as it is transported along the transport path 125, and particularly at respective areas of interest of the marked substrate as it is transported along the transport path 125. In the examples shown, the light sources 202 are positioned directly below the transport path for generating a light beam oriented at 0 degrees relative to a line normal to the transport path, where the direction and orientation of the light beam is shown by dotted arrow 206. The light sources 202 are shown in the present example to be laser light sources generating a continuous single beam laser. Other light sources are envisioned, such as LED light sources or light sources providing pulsed light. If pulsed, the pulsing period is faster than at least half of the time it takes for the marked features 511-514 and 711-714 to pass in front of the sensors 204 at full paper velocity, and faster than the time equivalent of the required measurement resolution for IOP registration station.

In FIG. 2, an illustration is provided of a photodetector 204 strategically positioned to sense light reflected from the target area of the marked substrate as it is transported along the transport path in the direction shown by arrow 210. In the example provided, the marked side of the substrate is transported marked image side face down on the photoreceptor belt 116 and the transport path 125. A light source 202 and the photodetector(s) 204 are positioned below the transport path 125. The photodetector(s) 204 are positioned to sense light reflected at an angle $\alpha$ relative to the line normal to the transport path 125. The angle $\alpha$ is 45 degrees in the present example. The direction and orientation of the sensed reflected light is shown by dotted arrow 208. The photodetector(s) 204 sense a target area which is determined by the field of view (FOV) of the photodetector(s) 204.

In order to illuminate the markings on the marked side of the substrate which is facing the transport path 125, the transport path 125 may be provided with a window that coincides with an area illuminated by the light source 202 and the target area sensed by photodetector(s) 204. As the marked substrate passes over the window the marked side of the substrate is illuminated and the reflected light is sensed by the photodetector(s) 204. Other configurations may be used for sensing the marked side of the substrate if it is facing the transport path 125, such as lifting the paper off of the transport path 125 using negative air pressure, and positioning the sensor(s) 204 and light source on the transport path 125 for illuminating and sensing reflected light from the marked side of the substrate.

In another ME architecture, the photoreceptor belt 116 is positioned above the paper paths 109 and 125, the marked side of the substrate is facing up, and the IOP registration station 126 is positioned above the paper path 125. In this case, special accommodations, such as providing a window in the photoreceptor belt 116 and lifting the paper off of the transport path 125, for sensing the marked substrate would not be necessary.

The photodetector(s) 204 are tuned to detect the edge of the substrate and the markings. In the present example, the transport path 125 is uncoated or is coated with a dark coating, the substrate used for measuring misregistration is white paper, the substrate is marked using black toner, and the sensor is tuned to have a threshold of substantially 50% reflectance. Other variations in coloring of the surface of the paper transport path 125, substrate and substrate markings and tuning of the sensor are envisioned, provided that there is a difference in reflectivity between the substrate and the surface of the transport path 125, and between the substrate and the substrate markings, where the differences in reflectivity are reliably detected by the sensor.

The light sources 202 and at least one photodetector 204 may be fixedly positioned, such as at the time of manufacture, at the time of installation, or during servicing and maintenance. Alternatively, the positions of the light sources 202 and/or photodetectors 204 may be adjustable. The photodetectors 204 may also be tuned to a predetermined setting, e.g., at the time of manufacture, at the time of installation, or during servicing and maintenance. The tuning setting may be fixed or adjustable, such as for performing a variety of diagnostic tests, e.g., running an IOP setup routine and verifying registration parameters with an eye loupe. Furthermore, it may be possible to enable and disable selected light sources 202 and/or photodetector(s) 204, such as for performing a variety of diagnostic tests, e.g., using different substrate sizes, etc.

FIG. 3 shows a first exemplary configuration of the IOP registration station 126 in which one light source 202 and one photodetector 204 are provided for illuminating and sensing a target area of the transport path 125. The photodetector 204 is positioned so that the target area will be within the focal length of the photodetector 204 and so that the photodetector 204 will satisfactorily sense features of a test pattern that is marked on the substrate as the substrate is transported along the transport path 125.

FIG. 4 shows a second exemplary configuration of the IOP registration station 126 in which a first light source 202 and a first photodetector 204 are provided for illuminating and sensing a first target area, and a second light source 202 and photodetector 204 are provided for illuminating and sensing a second target area of the transport path 125. The respective light sources 202 and photodetectors 204 are positioned so that the target areas will be within the focal length of the respective photodetectors 204 and so that the photodetectors 204 will satisfactorily sense features of a test pattern that is marked on the substrate as the substrate is transported along the transport path 125. The exemplary configurations shown are not limiting, and other configurations may be used. It is envisioned that one light source may be used for illuminating multiple target areas.

Figure 5:
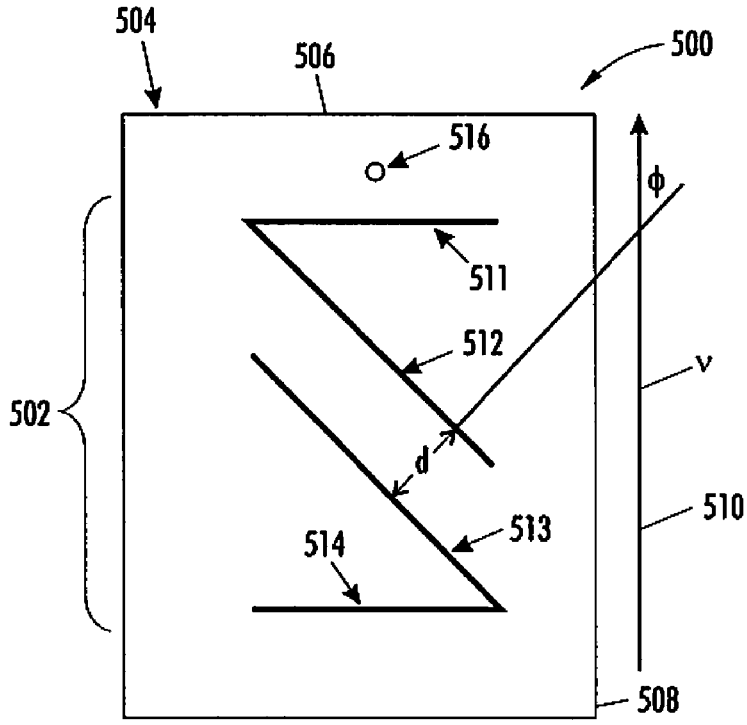
FIG. 5 is diagram of a paper substrate having a first exemplary test pattern in accordance with the present disclosure.
Figure 6:
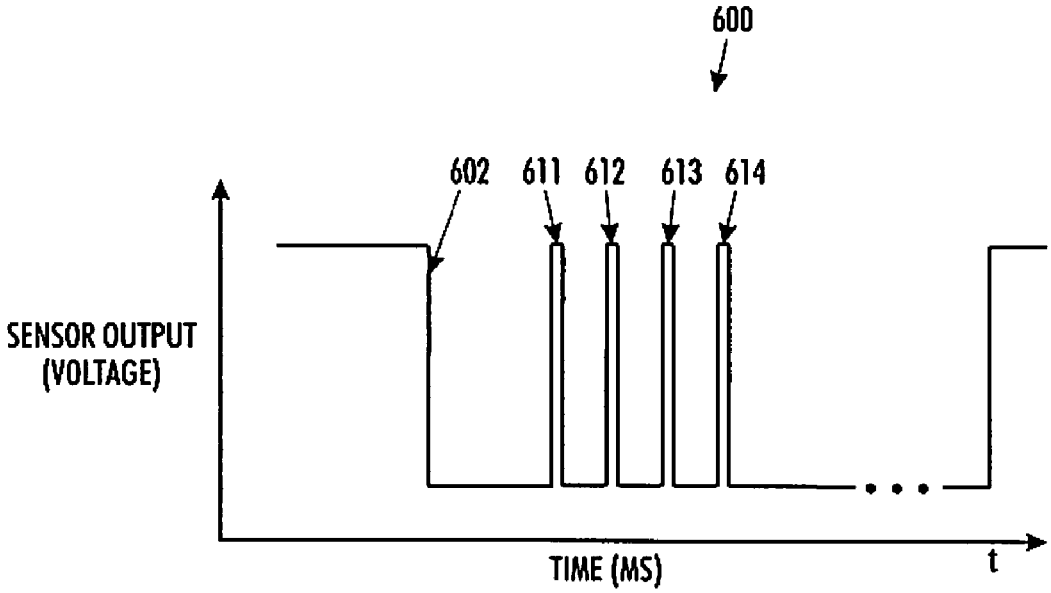
FIG. 6 is a plot of sensing output associated with sensing the first test pattern shown in FIG. 5.
Figure 7:
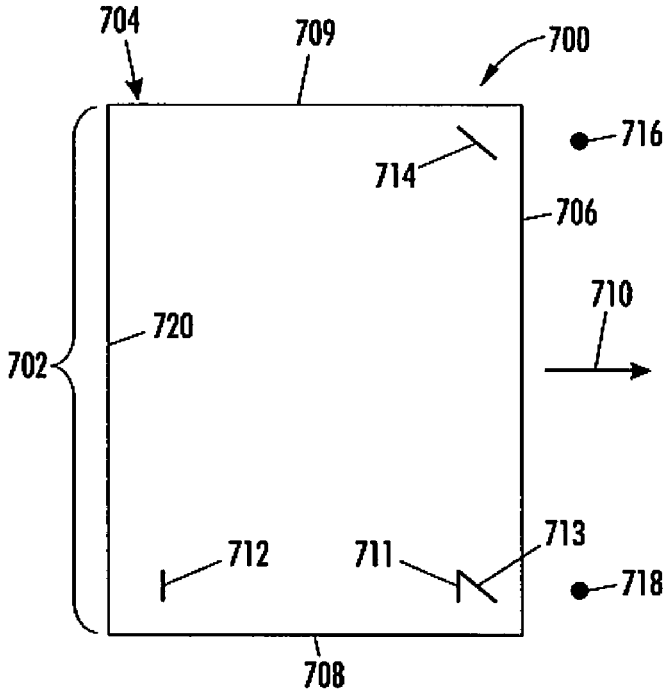
FIG. 7 is diagram of a paper substrate having a second exemplary test pattern in accordance with the present disclosure.
Figure 8:
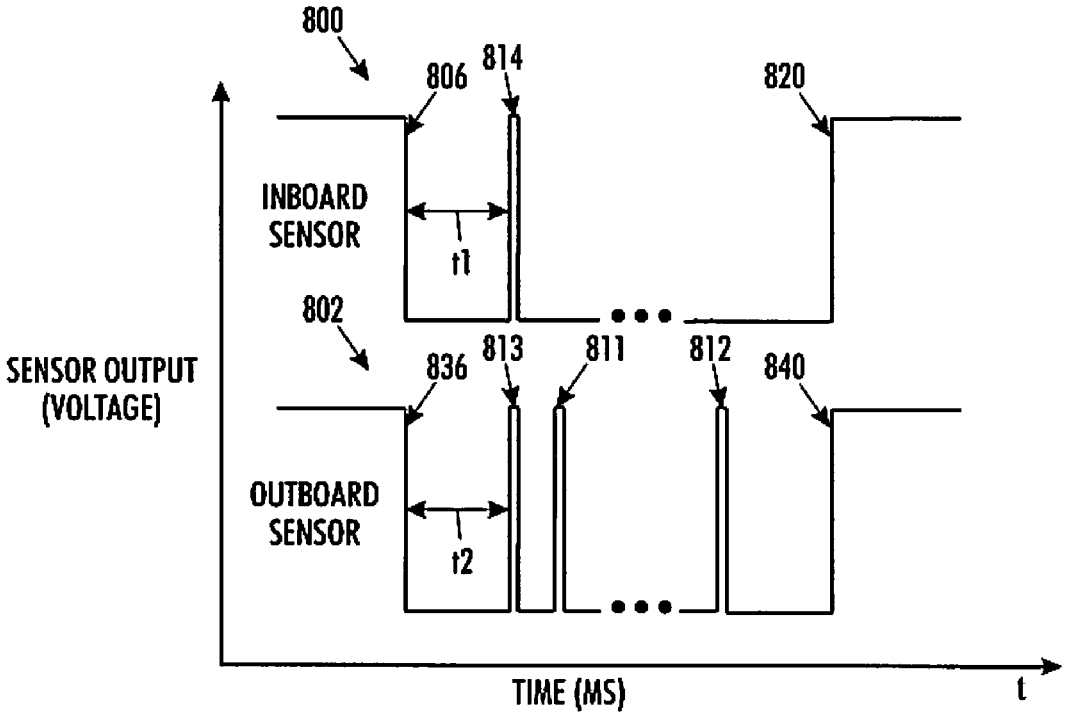
FIG. 8 is a plot of sensing output associated with sensing the second test pattern shown in FIG. 7.

FIGS. 5 and 7 show exemplary marked diagnostic pages, each having an exemplary test pattern which is sensed by sensor(s) 204 using the configuration shown. FIGS. 6 and 8 show the sensed output associated with sensing of the test patterns by photodetector(s) 204. The sensed output includes pulses, the timing of which is used by the IOP registration module 114 to reconstruct the image of the test pattern on the diagnostic page and to determine IOP misregistration accordingly. The test patterns may, for example, be resident in software and printed out by a digital printer, should the disclosure be used with a digital printer, and/or they may be scanned into a copy printer and printed out as a test pattern on a sheet, and/or they may be imaged from a document platen. The test patterns may be added on to one or more unused areas of a printed page, created by a variety of printing processes, and may further be trimmed off of the desired printed media, such as part of a secondary print process.

The individual marked diagnostic pages are transported along transport path 125 in the process direction 118, with a first and second features provided on a respective diagnostic pages sensed in a first and second sensing operation. Timing between the sensing of the first and second features is compared to a nominal time associated with no misregistration, for determining a misregistration error. For determination of one type of misregistration characteristic the first sensing operation is performed when the diagnostic page is at a first position on the transport path 125, and the second sensing operation is performed when the substrate is at a second position on the transport path. For determination of another type of misregistration characteristic the first sensing operation is performed with a first photodetector 204, and the second sensing operation is performed with a second photodetector 204.

FIG. 5 shows a first diagnostic page 500 having a first test pattern 502 marked on a paper 504 having lead edge 506 and outboard edge 508. The paper 504 is transported in the direction shown by arrow 510. The test pattern includes a plurality of features including features 511-514. Features of the first diagnostic page 500 include the features 511-514 of the first test pattern 502 and may further include one or more edges of the paper 504. A photodetector 204 is positioned so that its FOV, also referred to as sensing area 516, bisects each of the features 511-514 as the paper is transported.

Features 511-514 are lines or rectangles. Features 511 and 514 are printed nominally (with no image skew) substantially parallel to the lead edge 506. Feature 511 is a printed a predetermined distance from the lead edge 506. Features 512 and 513 are printed nominally substantially at a 45 degree angle to the lead edge 506. Features 512 and 513 are further printed substantially parallel to one another and separated by a predetermined distance, such as 1 cm. Features 511-514 are printed so that their width is greater than or equal to the FOV of the photodetector for optimizing resolution of the sensing by the photodetector 204.

FIG. 6 shows a plot 600 of sensor output versus time for diagnostics performed using the first test pattern 502 shown in FIG. 5. The sensor output is high when the reflectivity of the sensed area is low, such as when the surface of the transport path 125 without substrate, or a marked feature is positioned within the area being sensed. The falling edge 602 from high to low corresponds to sensing of the lead edge 506 of the paper 504. Pulses 611-614 correspond respectively to sensing of the features 511-514. The IOP registration module uses the timing of the sensor output signal, paper velocity data and printed image size and scale data to measure IOP registration.

Figure 9:
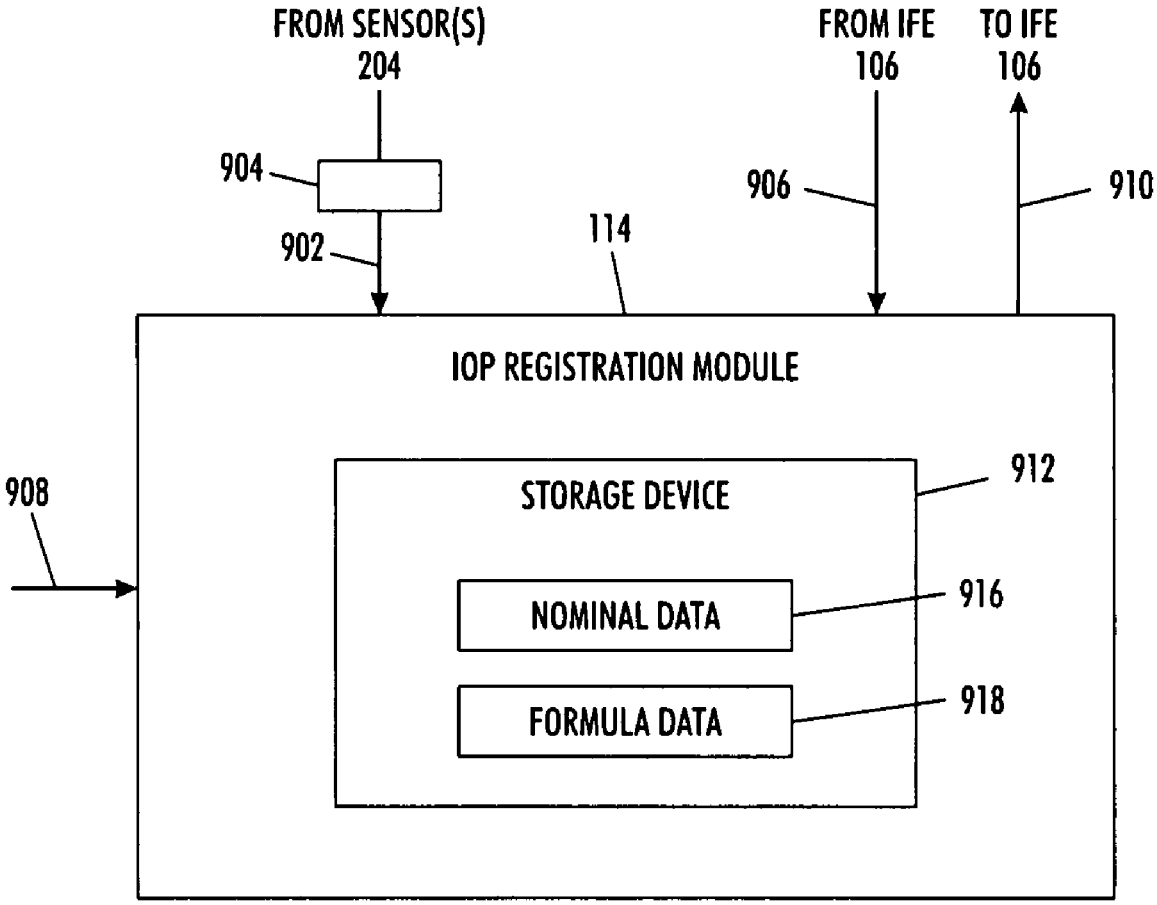
FIG. 9 is a block diagram of an IOP registration module 114 shown in FIG. 1.

FIG. 9 shows a more detailed view of the IOP registration module 114. The IOP registration module 114 receives sensing signal 902, input data 906 from the IFE 106, and paper velocity data 908, determines misregistration, and outputs correction control signals 910 which are provided to the IFE 106, or ME 102 for correction of the determined misregistration. The output from sensor 204 is operated on by one or more components 904, such as for buffering, filtering out noise, amplifying the signal, etc, which output sensing signal 902. In the present example, the component 904 is a Schmitt trigger which outputs a high value when the sensor 204's signal is above a first threshold value, outputs a low value when the sensor 204's signal is below a second, lower threshold value, and retains its current output value when the sensor 204's signal is in between the first and second threshold values.

Input data 906 includes synchronization signals, and image size and scale data. The synchronization signals are provided to the IOP module 114 to indicate when the sensor data is arriving. The image size and scale data tells the IOP registration module 114 what is the size and scale of the image of the marked test pattern 502 which was sensed by photodetector 204 and corresponds to signal 902. The paper velocity data 908 includes data from which paper velocity may be determined or estimated. For example, the paper velocity data 908 may included sensed data provided by two sensors for sensing the lead edge of the paper during transport at the IOP registration station 126, where the two sensors are spaced by a known distance apart. The time difference between edge sensing of the two sensors may be used to calculate the actual paper velocity. The paper velocity data 908 may include settings for the motor driving the transport of the paper, or encoder signals which sense the rotational speed of nips that grip the paper for transporting it, from which the paper velocity can be calculated.

The IOP registration module 114 further includes a storage device 912, such as RAM or Flash memory, which stores test pattern configuration data including nominal data 916 describing the nominal (ideal) features of each test pattern used (which may include where on the page the test pattern is marked, e.g., margins), and formula data 918 describing formulas for translating measured deviations from expected values into misregistration data. It is also within the scope of the present disclosure that the test pattern configuration data may be provided from an external source to the IOP registration module 114.

With respect to diagnosis of the first diagnostic page 500, the IOP registration module 114 uses the timing of the sensed signals plotted in FIG. 6 to determine IOP misregistration, including skew and cross-process and process offsets, and generate the correction control signals 910. With respect to skew misregistration, the timing differential between the sensing of two features of the first test pattern 502 is compared to an expected time differential. The expected time differential is determined using a) the nominal data 916 corresponding to the nominal distance between the two features of interest, and b) paper velocity data 908. In the present example, the timing differential between the sensing of features 512 and 513 (e.g., the falling edge of pulses 612 and 613) is compared to the expected timing differential for those features. The disclosure is not limited to using features 512 and 513, as described, for determining skew misregistration, and instead other features of the first diagnostic page 500 may be used. Furthermore, when measuring the time differential between pulses, rising edges may be used instead of falling edges, provided that the edges used are both rising edges.

When the measured timing differential (corresponding to the sensing) is larger than the expected timing differential, it indicates that there is a clockwise skew misregistration error, and when the measured timing differential is smaller than the expected timing differential, it indicates that there is a counterclockwise skew misregistration error. The magnitude of the difference between the measured timing differential and the expected timing differential is equal to $d/(v*\cos(\phi))$, where d is the distance between features 512 and 513, v is the velocity of the paper, and $\phi$ is the angle between the line normal to features 512 or 513 and the direction of paper travel 510, where $\phi$ is ideally 45 degrees. If the paper edges 506 and 510 are known (either by other sensors, such as a CCD arrays, or the paper is accurately registered such as with a hard guided edge or in the transfer area 128), then $\phi$ can be related to the lead edge 506. Accordingly, the angle $\phi$ is determined based on the difference between the measured timing differential and the expected timing differential. A skew error value (SE) is determined by $SE=ar\cos(d/tv)-45$ degrees, where d is the distance between features 512 and 513, t is the differential time between falling edges of pulses 612 and 613, and v is the velocity of the paper. A correction control signal is generated based on SE. Each time that a correction control signal is sent to the IFE 106, the IFE 106 makes necessary adjustments to perform the correction.

The calculations for determining cross-process and process offsets are simplified, as described below, when any skew misregistration has already been corrected. Accordingly, in the present example, the IOP registration module 114 generates a correction control signal 910 for correction of the skew misregistration by the IFE 106 in accordance with SE, and the IFE 106 makes adjustments in accordance with the correction control signal 910.

With respect to determination of process and cross-process offsets, the calculations are simplified, as described below, when any skew misregistration has already been corrected. Accordingly, after adjustments have been made by the IFE 106 for correcting for skew misregistration, a second diagnostic page having the first test pattern 502, and which is the same as the first diagnostic page 500, is marked on the paper 504. It is envisioned that process and cross-process offsets may be determined using the first diagnostic page, and that determined skew misregistration would be compensated for in the calculations.

With respect to cross-process offset misregistration, the timing differential between the sensing of features 511 and 512 (e.g., between the falling edges of pulses 611 and 612) is compared to an expected timing differential corresponding to those features (using the nominal data 916 and paper velocity data 908). When the measured timing differential is larger than the expected timing differential, it indicates that the image is shifted (offset in the cross-process direction) towards outboard edge 508, and vice versa. Since feature 511 is oriented 45 degrees with respect to feature 512, the difference between the measured time differential and the expected time differential is related to cross-process offset misregistration by a 1:1 ratio. A cross-process offset error value (CPOE) is thus generated based on the difference between the measured time differential and the expected time differential.

Other features may be used for determining cross-process offset. For example, the timing between falling edges corresponding to features 513 and 514 (e.g., the falling edges of pulses 613 and 614) may be used. For an even more accurate determination of CPOE, the timing differential between falling edges corresponding to features 511 and 512 in conjunction with the timing differential between falling edges corresponding to features 513 and 514 may be used in a differential mode.

With respect to offset in the process direction, the timing differential between the sensing of the lead edge 506 and feature 511 (e.g., between falling edge 602 and the falling edge of pulse 611) is compared to an expected timing differential for those features (using the nominal data 916 and the paper velocity data 908). When the measured timing differential is smaller than the expected timing differential, it indicates that the image is shifted (offset in the process direction) towards lead edge 506, and vice versa. The difference between the measured and expected timing differentials is related to process offset misregistration by a 1:1 ratio when there is no image skew misregistration. A process offset error value (POE) is thus generated based on the difference between the measured time differential and the expected time differential, and a correction control signal is generated accordingly. A correction control signal is generated based on CPOE and POE. The order in which CPOE and POE are determined relative to one another is not critical.

For improved accuracy of image skew and cross-process offset misregistration measurements, the first test pattern 502 may be repeated one or more times on the diagnostic page 500, and the sensed measurements may be averaged. Similarly, for improved accuracy of determination of mean image skew and cross-process and process offset misregistration measurements, the first test pattern 502 may be repeated and measurements taken on multiple diagnostic pages substantially identical to diagnostic page 500.

Accuracy for determining image skew and process and cross-process image offset further depends on using known factors including the paper velocity, paper skew and cross-process paper offset registration when the diagnostic page is being sensed by the photodetector 204. One location where the above factors are tightly constrained which may be ideal for positioning of the IOP registration station 126 is at or after the toner image is transferred to the paper at the transfer station 124. However, the IOP registration station 126 may be positioned at other locations of the printing system 100 by providing one or more registration sensors (not shown) for sensing paper registration and means for determining the paper velocity. The registration sensors are typically CCD sensors. For example, one CCD sensor may be used for measuring the location of the outboard edge 508, and an additional CCD sensor may be provided for measuring paper skew, where the measurements may be instantaneous or dynamic, and may be made when the IOP misregistration measurements are made. Means for measuring paper velocity are described above. A specially designated encoder and/or paper nip may be provided for determining paper velocity at the location of the IOP registration station 126.

After image skew and process and cross-process image offset misregistration have been determined and corresponding adjustments made by the IFE 106, additional misregistration factors, including image magnification errors in the process and cross-process directions, are determined and corrected. Image magnification errors may be caused by mechanical misalignments of the imaging system, by paper-expansion, such as when the paper is fused, or by paper-shrinkage, such as when the paper cools to room temperature. Measurement accuracy is improved by diagnosing image magnification errors after image skew and process and cross-process offset errors have been corrected. Additionally, accuracy can be improved by averaging results performed on multiple test patterns per page, and/or using multiple pages each having at least one test pattern. It is envisioned that process and cross-process image magnification errors may be determined before adjustments have been made by the IFE 106, and that determined image skew misregistration and process and cross-process offset misregistration would be compensated for in the calculations. Furthermore, any known paper skew misregistration or paper process or cross-process offset misregistration that is not corrected for is compensated for in the calculations.

FIG. 7 shows a third diagnostic page 700 used for determining additional misregistration errors including measuring image magnification errors. The third diagnostic page 700 has a second test pattern 702 marked on a paper 704 having lead edge 706 and outboard edge 708. The paper is transported in the direction shown by arrow 710. The second test pattern 702 includes a plurality of features including features 711-714. Features of the third diagnostic page 700 include the features 711-714 of the second test pattern 702 and may further include one or more edges of the paper 704.

The sensor employed for diagnosis using second test pattern 702 includes an inboard photodetector 716 positioned so that its FOV will be near the inboard edge 709 of the paper 704, and an outboard photodetector 718 positioned so that its FOV will be near the outboard edge 708 of the paper 704, as the paper 704 is transported. The inboard photodetector 716 and outboard photodetector 718 are aligned with one another along the process direction. The first photodetector 716 is positioned so that its FOV (i.e., sensing area) bisects feature 714 with no image skew error, and the second photodetector 718 is positioned so that its FOV bisects features 711-713 with no image skew error. The test patterns 502 and 702 and the features of the test patterns 502 and 702 are exemplary, and other test patterns having different features may be used to determine the image on paper misregistration, skew and magnification errors.

FIG. 8 shows a first plot 800 of output from the inboard sensor 716, and a second plot 802 of output from the outboard sensor 718, both plotted versus time and corresponding to diagnostics performed using the second test pattern 702 shown in FIG. 7. In the first plot 800, the falling edge 806 corresponds to sensing the lead edge 706 of the paper 704, pulse 814 corresponds to sensing of the feature 714, and rising edge 820 corresponds to the trail edge 720 of the paper 704. In the second plot 802, the falling edge 836 corresponds to sensing the lead edge 706 of the paper 704, pulses 811-813 correspond to sensing of the features 711-713, respectively, and rising edge 840 corresponds to the trail edge 720 of the paper 704.

With respect to diagnosis of the second diagnostic page 700, the IOP registration module 114 uses the timing of the sensed signals plotted in FIG. 8 to determine IOP misregistration, including cross-process and process image magnification misregistration, and to generate the correction control signals 910. The IOP registration module 114 must know which diagnostic page is being used in order to use the appropriate test pattern configuration data for generating correction control signals 910 to the IFE 106. The IOP registration module 114 is either signaled by the IFE 106 that the second diagnostic page 700 is arriving, or it expects the second diagnostic page 700 to arrive because of programmed instructions on its processor.

With respect to determination of cross-process image magnification, the timing of the sensing of features 714 and 713 relative to the sensing of the lead edge 706 are compared by comparing the time t1, which is the timing differential between the timing of falling edge 806 and of the falling edge of pulse 814, with time t2, which is the differential between the timing of falling edge 836 and of the falling edge of pulse 813. It is also within the scope of the disclosure for t1 and t2 to be absolute times at which features 714 and 713 are sensed, respectively, as opposed to times that are relative to the sensing of the lead edge 706.

As features 714 and 713 are each bisected by the FOV of sensors 716 and 718, respectively, and sensors 716 and 718 are aligned with each other in the process direction, when cross-process magnification is nominal (e.g., equal to 1) and image skew error=0, then t1=t2. If t1>t2, then the magnification is less than one, and the image is smaller than nominal, and if t2<t1, then the magnification is greater than one, and the image is larger than nominal, both indications of magnification error. The cross-process magnification (CPM) is determined in accordance with the formula: $CPM=(L_{CP}+(t2-t1)/v)/(L_{CP})$ where $L_{CP}$ is the nominal distance between features 713 and 714 with cross-process magnification=1, and v=paper velocity. A cross-process magnification value is generated based on CPM.

With respect to determination of process image magnification, the timing differential between the falling edges of pulse 811 and pulse 812, which corresponds to the timing differential between the sensing of features 711 and 712, is compared to an expected time differential. The expected time differential is based on a nominal image (e.g., in which magnification is equal to one) and the paper velocity. The determination of paper velocity is described above. If the measured time differential is more than the expected time differential, then the process image magnification is greater than one, and vice versa. The process magnification (PM) is determined in accordance with the formula: $PM=t/vL_p$, where t is the differential time between falling edges of features 811 and 812, v is the paper velocity and $L_p$ is the nominal distance between features 711 and 712 with process magnification=1. A process magnification value is generated based on PM.

A correction control signal is generated based on CPM and PM. The order in which CPM and PM are determined relative to one another is not critical. Furthermore, it is possible that CPM and PM are measured and corrected for prior to measuring and correcting for CPOE and POE.

The above described printing of the first and/or second diagnostic pages, sensing and analysis of the features of the printed pages, generation of correction control signals and adjustments to the IFE 106 may all be included within a diagnostic routine. More than one diagnostic routine may be available, such as a first routine for automatically diagnosing and correcting all of the misregistration factors described above (image skew, image offset in the process and cross-process directions and image magnification in the process and cross-process directions), and subsequent routines for diagnosing and correcting only one misregistration factor or a combination of misregistration factors. A diagnostic routine may be initiated by an operator or automatically by a control routine of the printer, such as in accordance with a schedule based on time or number of pages executed by the printer. The diagnostic pages used may be output to a purge tray 134 of the substrate output source 110 to prevent the diagnostic pages from getting mixed up with pages of a document. The purge tray 134 is specially designated for pages to be purged that should not be mixed in with user submitted documents not related to diagnostic testing. Furthermore, the initiation and/or performance of the diagnostic routine may be transparent to the user.

Figure 10A:
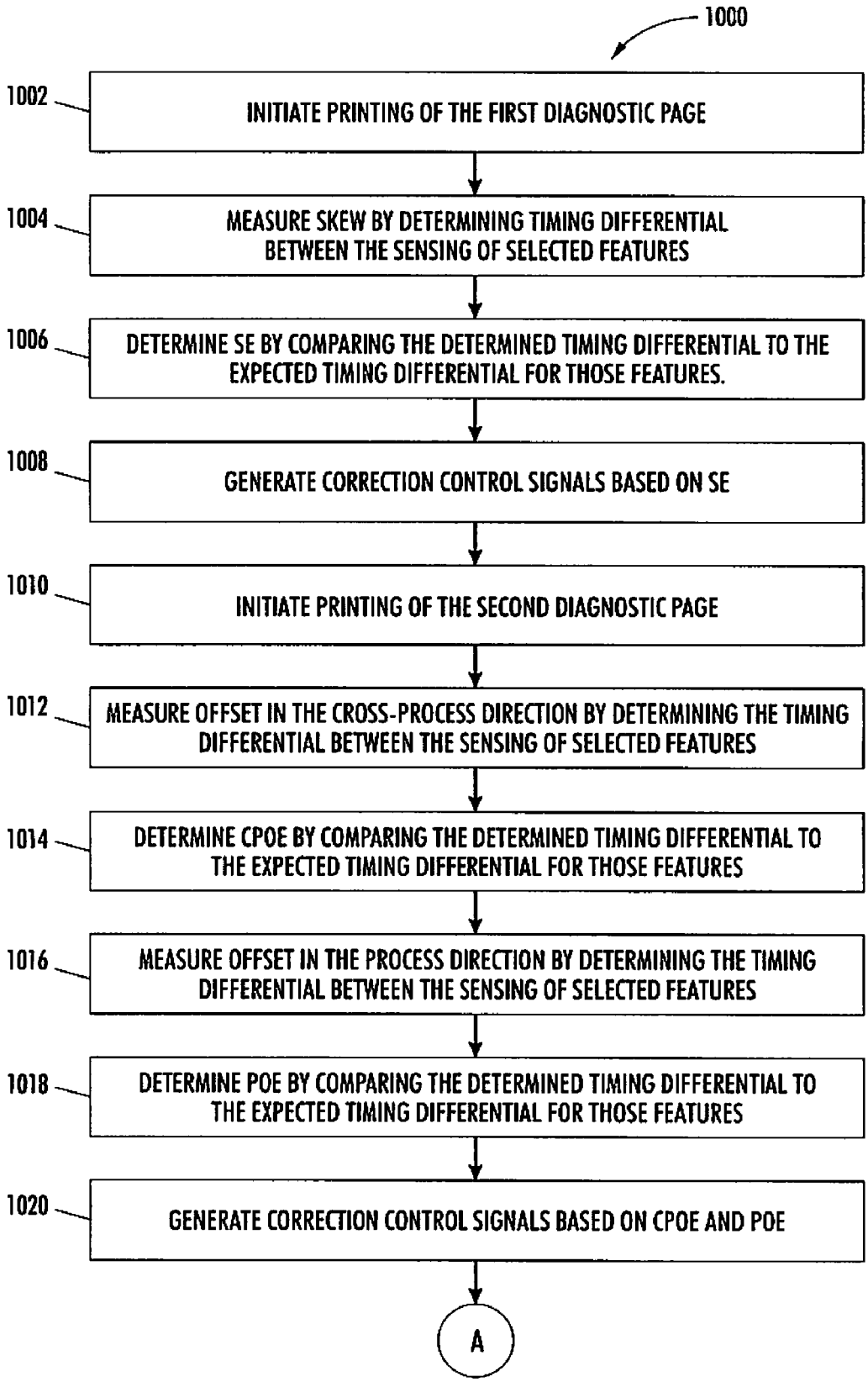
FIGS. 10A-10B show a flowchart of steps performed by the IOP registration module shown in FIG. 9.
Figure 10B:
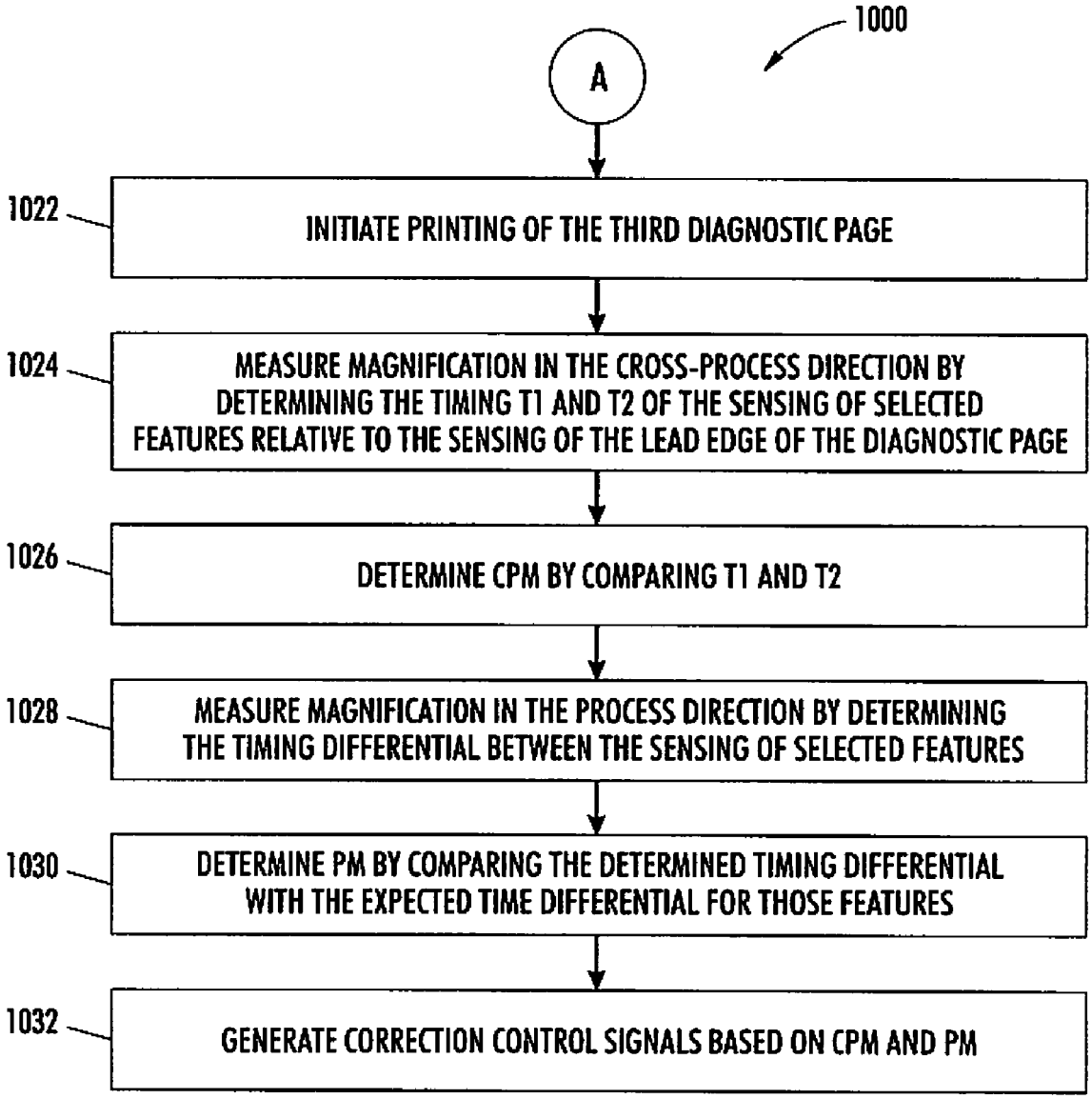

FIGS. 10A-10B shows a flowchart 1000 of steps performed by the IOP registration module 114 during a diagnostic procedure. At step 1002, printing of the first diagnostic page is initiated. At step 1004, the image skew is measured by determining the timing differential between the sensing of features 512 and 513 (e.g., between the falling edge of pulses 612 and 613). At step 1006, SE is determined by comparing the timing differential determined in step 1004 to the expected timing differential for those features. At step 1008, correction control signals are generated based on SE. The IFE 106 performs adjustments to the image based on the correction control signals, or the ME 104 makes an adjustment to the paper registration. The adjustments are performed before the next diagnostic page is printed.

At step 1010, printing of the second diagnostic page is initiated. At step 1012, offset in the cross-process direction is measured by determining the timing differential between the sensing of features 511 and 512 (e.g., between the falling edges of pulses 611 and 612). At step 1014, CPOE is determined by comparing the timing differential determined in step 1012 to the expected timing differential corresponding to those features.

At step 1016, offset in the process direction is measured by determining the timing differential between the sensing of the lead edge 506 and feature 511 (e.g., between falling edge 602 and the falling edge of pulse 611). At step 1018, POE is determined by comparing the timing differential determined in step 1016 to the expected timing differential for those features. At step 1020, correction control signals based on CPOE and POE are generated. The IFE performs adjustments based on the correction control signals. The adjustments are performed before the next diagnostic page is printed.

At step 1022, printing of the third diagnostic page is initiated. At step 1024, magnification in the cross-process direction is measured by determining the timing of the sensing of features 714 and 713 relative to the sensing of the lead edge 706, respectively. This is done by determining time t1, which is the differential between the timing of falling edge 806 and of the falling edge of pulse 814, with time t2, which is the differential between the timing of falling edge 836 and of the falling edge of pulse 813. At step 1026, CPM is determined by comparing t1 and t2.

At step 1028, magnification in the process direction is measured by determining the timing differential between the sensing of features 711 and 712 (e.g., between the falling edge of pulse 811 and the falling edge of pulse 812). At step 1030, PM is determined by comparing the timing differential determined at step 1028 with the expected time differential for those features. At step 1032, correction control signals based on CPM and PM are generated. The IFE performs adjustments based on the correction control signals.

A traditional IOP measurement procedure, such as via a scanner or use of an eye loupe, may still be used for setting up hardware (e.g., to align sensors), such as via a one-procedure test performed at the time of manufacturing, or in the field upon replacement of sensors or printer hardware, such as paper transport 125. Once the hardware is setup, periodic running of the diagnostic routine described with reference to FIGS. 1-10 is used to maintain IOP registration.

The IOP registration system and method described is particularly useful for printers having more than one printer engine, where each IFE requires identical IOP registration. Further more, the IOP system and method described may be used for color printers as well, such as where each color is marked using a different printer engine. One IOP registration station 126 may be provided for determining IOP misregistration for all of the printer engines. The photodetector(s) 204 are tuned to sense the colors used by all of the printer engines. Tuning may be performed in real time or at the time of manufacture. Calibration of the sensors 204 may also be performed in real time. Furthermore, the IOP registration method may be performed for a first side of a substrate and then repeated for the second side when performing IOP registration for two-sided printing.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for adjusting image on paper (IOP) misregistration in a printing device, the method comprising:

(A) receiving a substrate marked with a test pattern, the test pattern having at least one feature, and the marked substrate including at least two features including the at least one feature of the test pattern;

(B) sensing in a first sensing operation, as the substrate is transported in a process direction along a transport path, a first feature of the at least two features of the marked substrate;

(C) sensing in a second sensing operation, as the substrate is transported in the process direction along the transport path, a second feature of the at least two features of the marked substrate, wherein at least one of the first and second features is included in the at least one feature of the test pattern;

(D) measuring a time differential between the sensing of the first and second features; and (E) determining an IOP misregistration characteristic based at least on the measured time differential;

(F) generating a correction control signal corresponding to the determined IOP misregistration characteristic;

(G) providing the correction control signal to at least one of an image forming engine and a marking engine for adjustment of the IOP registration;

(H) performing steps (A)-(G) using a first substrate marked with a first test pattern, wherein the IOP misregistration characteristic is image skew; and (I) performing steps (A)-(E) using a second substrate marked with a second test pattern, wherein the IOP misregistration characteristic determined is image offset in one of the process direction and a cross-process direction.

2. The method according to claim 1, wherein the first sensing operation is performed when the substrate is at a first position on the transport path, and the second sensing operation is performed when the substrate is at a second position on the transport path.

3. The method according to claim 1, wherein the first sensing operation is performed with a first sensor, and the second sensing operation is performed with a second sensor.

4. The method according to claim 1, wherein the sensing of at least one of the first and second sensing operations includes using a point sensor generating a single binary signal.

5. The method according to claim 1, wherein the IOP misregistration characteristic is selected from the group of IOP misregistration characteristics consisting of: image magnification in a cross-process direction, and image magnification in the process direction.

6. The method according to claim 1, comprising:

performing steps (B)-(G) using the second substrate, wherein the IOP misregistration characteristic determined is image offset in the other of the process and cross-process directions, and wherein the correction control signal corresponds to the determined image offset in the process and cross-process directions.

7. The method according to claim 6, after performing the steps using the first and second substrates:

performing steps (A)-(E) using a third substrate marked with a third test pattern, wherein the misregistration characteristic determined is image magnification in one of the process and cross-process directions;

performing steps (B)-(G) using the third substrate, wherein the misregistration characteristic determined is image magnification in the other of the process and cross-process directions, and wherein the correction control signal corresponds to the determined image magnification in the process and cross-process directions.

8. The method according to claim 1, wherein the substrate is provided to a tray designated for purging.

9. The method according to claim 1, wherein the determining in step (E) includes comparing the measured time differential to an expected time differential value.

10. The method according to claim 9, wherein the expected time differential value is based on at least one of the velocity of the substrate during transport and test pattern configuration data.

11. An electrophotographic printing system comprising:

a marking engine for transporting a substrate in a process direction and marking the substrate in accordance with an image of a test pattern, the test pattern having at least one feature, wherein the marked substrate includes at least two features including the at least one feature of the test pattern;

an image on paper (IOP) registration station including at least one sensor for sensing the marked substrate as it is transported, including in a first sensing operation sensing a first feature of the at least two features of the marked substrate, and in a second sensing operation sensing a second feature of the at least two features of the marked substrate, wherein at least one of the first and second features is included in the at least one feature of the test pattern;

a control unit including at least one processor; and an IOP registration module including a series of programmable instructions executable by the processor for measuring a time differential between the sensing of the first and second features; determining an IOP misregistration characteristic based at least on the measured time differential; generating a correction control signal corresponding to the determined IOP misregistration characteristic; providing the correction control signal to at least one of an image forming engine and a marking engine for adjustment of the IOP registration;

wherein a first substrate is marked with a first test pattern, wherein the IOP misregistration characteristic is image skew; and wherein a second substrate is marked with a second test pattern, wherein the IOP misregistration characteristic determined is image offset in one of the process direction and a cross-process direction.

12. The printing system in accordance with claim 11, wherein a sensor of the at least one sensor is a point sensor generating a single binary signal.

13. The printing system in accordance with claim 11, wherein the IOP misregistration characteristic is selected from the group of IOP misregistration characteristics consisting of: image magnification in the cross-process direction, and image magnification in the process direction.

14. The printing system in accordance with claim 13, wherein the image formation engine (IFE) provides the image as a latent image conducive for marking the latent image on the substrate;

wherein the IOP registration module includes the series of programmable instructions executable by the processor for generating the correction control signal corresponding to the determined IOP misregistration characteristic, and providing the correction control signal to at least one of the IFE and the marking engine for adjustment of the IOP registration.

15. The printing system according to claim 11, wherein the IOP registration module determines the IOP misregistration characteristic by comparing the measured time differential to an expected time differential value.

16. The printing system according to claim 15, wherein the expected time differential value is based on at least one of the velocity of the substrate during transport and test pattern configuration data.

17. A control unit of a printing system for correcting image on paper (IOP) misregistration, the control unit comprising:

a processor; and an IOP registration module including a series of programmable instructions executable by the processor for:

(A) initiating marking of a substrate with a test pattern having at least one feature, the marked substrate including at least two features including the at least one feature of the test pattern;

(B) processing signals associated with sensing a first feature of the at least two features of the marked substrate in a first sensing operation as the substrate is transported in a process direction along a transport path;

(C) processing signals associated with sensing a second feature of the at least two features of the marked substrate in a second sensing operation as the substrate is transported in the process direction along the transport path, wherein at least one of the first and second features is included in the at least one feature of the test pattern;

(D) measuring a time differential between the at sensing of the first and second features;

(E) determining an IOP misregistration characteristic based at least on the measured time differentials;

(F) generating a correction control signal corresponding to the determined IOP misregistration characteristic;

(G) providing the correction control signal to at least one of an image forming engine and a marking engine for adjustment of the IOP registration;

(H) performing steps (A)-(G) using a first substrate marked with a first test pattern, wherein the IOP misregistration characteristic is image skew; and (I) performing steps (A)-(E) using a second substrate marked with a second test pattern, wherein the IOP misregistration characteristic determined is image offset in one of the process direction and a cross-process direction.

18. The control unit in accordance with claim 17, wherein the IOP registration module determines the IOP misregistration characteristic by comparing the measured time differential to an expected time differential value.

19. The control unit in accordance with claim 18, wherein the expected time differential value is based on at least one of the velocity of the substrate during transport and test pattern configuration data.

* * * * *